US007981015B2

(12) United States Patent
Reed

(10) Patent No.: US 7,981,015 B2
(45) Date of Patent: Jul. 19, 2011

(54) APPARATUS AND METHOD OF MANUFACTURE FOR AN ANATOMICAL STRETCHING DEVICE

(75) Inventor: Michael Reed, Scottsdale, AZ (US)

(73) Assignee: Power Stretch, LLC, Scottsdale, AZ (US)

( * ) Notice: Subject to any disclaimer, the term of this patent is extended or adjusted under 35 U.S.C. 154(b) by 0 days.

(21) Appl. No.: 12/488,903

(22) Filed: Jun. 22, 2009

(65) Prior Publication Data

US 2010/0323860 A1 Dec. 23, 2010

(51) Int. Cl.
*A63B 21/00* (2006.01)

(52) U.S. Cl. ..... 482/131; 482/907

(58) Field of Classification Search ..... 482/907, 482/111–113, 131, 129, 148, 133–135, 72
See application file for complete search history.

(56) References Cited

U.S. PATENT DOCUMENTS 5,108,090 A 4/1992 Reed
5,277,681 A * 1/1994 Holt ..... 482/112
5,616,110 A * 4/1997 Nascimento ..... 482/131
6,210,348 B1 * 4/2001 Reed ..... 601/23
6,634,995 B1 10/2003 Reed
6,733,426 B2 * 5/2004 Bussell ..... 482/112
7,393,310 B2 * 7/2008 Andrews ..... 482/131

* cited by examiner

*Primary Examiner* — Fenn C Mathew
(74) *Attorney, Agent, or Firm* — The NOblitt Group, PLLC

(57) ABSTRACT

Apparatuses, methods, and systems for increasing flexibility and/or stretching the muscles of a user generally comprise a user support set atop an enclosure. The enclosure houses mechanisms to actuate a cable system, wherein the mechanisms at least one of feed and retract a cable of the cable system. The apparatuses, methods, and systems also comprise footholds proximate to the user support to support at least the feet from a user, wherein the cable system actuates between the footholds, and wherein the footholds actuate in at least a lateral motion to further accentuate increasing flexibility and/or stretching the muscles. The apparatuses, methods, and systems also comprise a control handle coupled to the cable system for the user to grasp, wherein the cable system actuates to either one of increase and release a tension to the grasped control handle, and wherein the control handle comprises at least one control to regulate the either one of increase and release the tension.

4 Claims, 11 Drawing Sheets

APPARATUS AND METHOD OF MANUFACTURE FOR AN ANATOMICAL STRETCHING DEVICE

FIELD OF INVENTION

The present invention generally concerns exercise equipment, and more particularly, representative and exemplary embodiments of the present invention generally relate to apparatuses, systems, devices and methods relating to an anatomical stretching device.

BACKGROUND OF INVENTION

Personal healthcare is a growing modern phenomenon as individuals become more and more health conscious. As part of a regular healthcare regiment, users incorporate various anatomical strength and conditioning programs. As part of such strength and conditioning programs, users often rely upon various exercise equipment. While much of this equipment is directed towards strength training, few are directed primarily with stretching and/or increasing a user's flexibility. It is well known that as a user's muscle develops, the muscles tend to lose a fair amount of flexibility. Also, a user undertaking a strength and conditioning regiment may be out of shape and lack adequately stretched muscles and/or have limited flexibility, which is a desired precursor to more advanced strength and conditioning.

As mentioned briefly, few devices exist that are directed towards increasing flexibility and/or stretching muscles, and those that do exist are active devices that require significant effort on the part of the user, e.g. the user must exert physical effort to push and pull themselves in conjunction with the various equipment. Thus the user may tire before adequately stretching their muscles. A passive device that a user can operate to increase flexibility and/or stretch their muscles without exerting great physical effort, thereby obtaining a complete stretching before tiring from any pushing or pulling, is disclosed.

SUMMARY OF THE INVENTION

In various representative aspects, the present invention to increase flexibility and/or stretch the muscles of a user generally includes, among other elements, (a) a user support to support the user; (b) an enclosure, wherein the enclosure houses mechanisms to actuate a cable system; (c) footholds proximate to the user support to support feet from the user; and (d) a control handle for the user to grasp, wherein the control handle is coupled to the cable system.

The housed mechanisms operate to feed and retract a cable of the cable system, wherein the cable system may actuate between the footholds. In an embodiment the footholds may actuate in a lateral direction to further accentuate increasing flexibility and/or stretching muscles. However, in other embodiments the footholds may actuate in a longitudinal direction, as well as in combinations of both lateral and longitudinal direction. The cable system operates to either one of increase and release a tension of the grasped control handle, and the control handle may comprise at least one control to regulate the either one of increase and release the tension.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware and/or software components configured to perform the specified functions and achieve the various results. For example, the present invention may employ various user supports and mechanism enclosures, footholds, control handles, cable systems, and the like, which may carry out a variety of functions. In addition, the present invention may be practiced in conjunction with any number of strength and conditioning equipment, and the apparatus, device, and/or system described is merely an exemplary application for the invention. Further, the present invention may employ any number of conventional techniques for increasing flexibility, stretching muscles, and the like.

Figure 1:
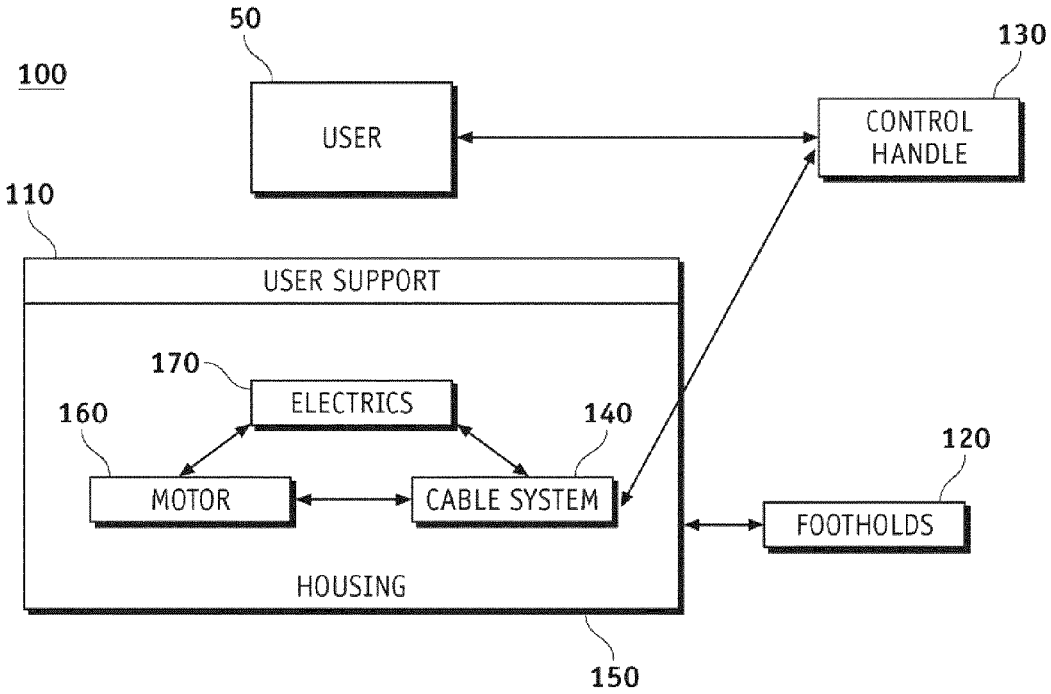
FIG. 1 representatively illustrates a block diagram of the present invention.

Various representative implementations of the present invention may be applied to any apparatus for stretching muscles and/or increasing flexibility for a user. Referring now to FIG. 1, an exemplary embodiment of an apparatus 100 to increase the flexibility and/or stretch the muscles of a user 50 is shown by the block diagram. In accordance with an exemplary embodiment of the present invention, the apparatus 100 may comprise a user support 110 to support the user 50, footholds 120, which may be proximate to the user support 110 to support feet from the user 50, and a control handle 130 for the user 50 to grasp. The control handle 130 may be coupled to a cable system 140, and in conjunction with the user support 110 and the footholds 120, the cable system 140 may actuate to facilitate increasing the flexibility and/or stretch the muscles of the user 50. In an embodiment, the user support 110 may set upon an enclosure 150 that may fully or partially house the cable system 140, as well as house various hardware components, such as a motor 160. The enclosure 150 may further house various other components, such as electronics 170, drive systems, displays, computational devices, and the like.

Figure 3:
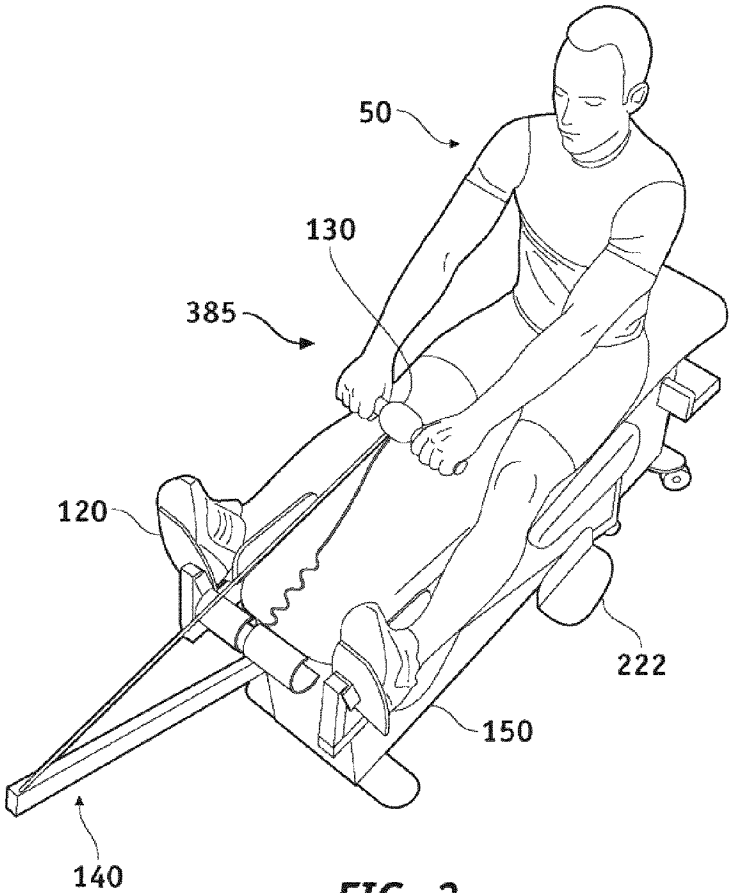
FIG. 3 representatively illustrates the exemplary embodiment of the present invention showing the user in a second position.
Figure 2:
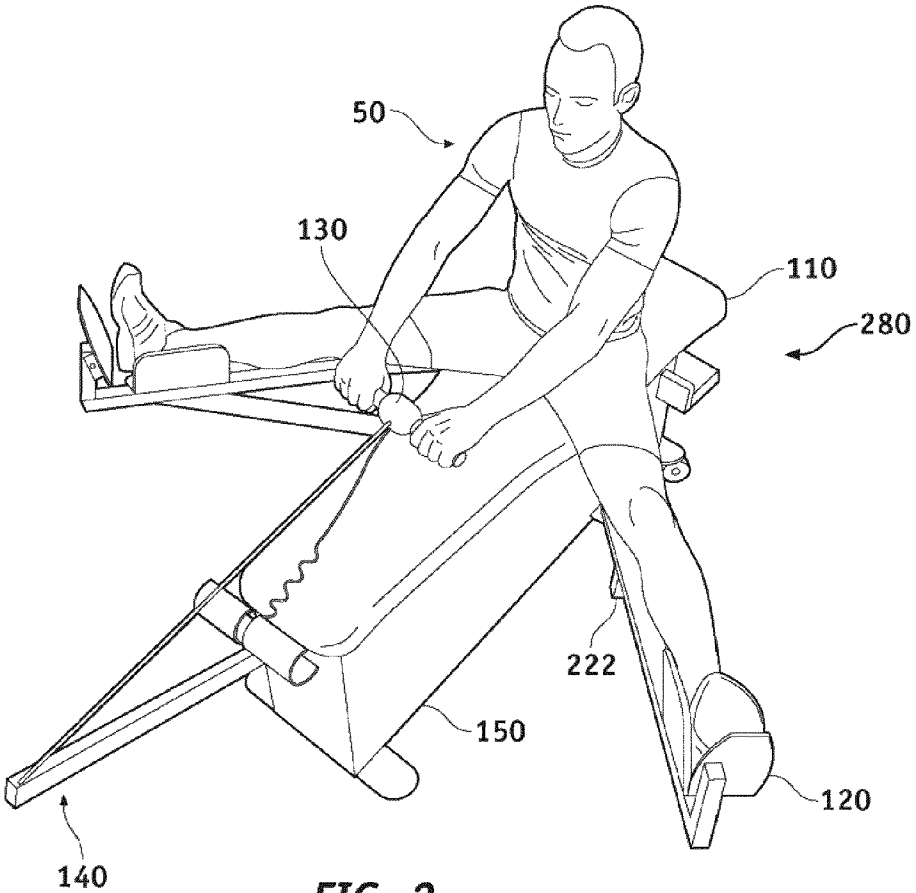
FIG. 2 representatively illustrates a exemplary embodiment of the present invention showing a user in a first position.

In accordance with an exemplary embodiment of the present invention, the apparatus 100 may comprise the user support 110. With reference to FIGS. 2 and 3, an exemplary user support 110 is shown to support the user 50. In an embodiment, the user support 110 may support the user 50 during use of the apparatus 100. For example, the user support 110 may comprise a bench that sets atop the enclosure 150, as shown in FIGS. 2 and 3, but in alternate embodiments the user support 110 may comprise a seat (not shown) having a back to also support the user 50. In still another embodiment, the user support 110 may comprise an extension 1010 coupled to other parts of the enclosure 150 to support the knees or feet of the user 50, such as shown in FIGS. 10H and 10I, or the user support 110 may comprise any other component now known or developed in the future that may support a user 50. Among the exemplary embodiments, the user support 110 may be adjustable to accommodate variable sized users. The user support 110 may also comprise a lap belt to secure the position of the user 50. Among various exemplary embodiments, the user support 110 may comprise various materials, padding, and the like to facilitate comfort and hygienic maintenance.

In accordance with another exemplary embodiment, to further facilitate stretching a user's muscles and/or increase flexibility, the user support 110 and/or 1010 may actuate to alter the position of the user 50. For example, the user support 110, such as a seat having a back, may systematically, during operation of the apparatus, move in a back and forth motion, in an up and down motion, or a side to side motion, and/or any combination thereof.

In accordance with exemplary embodiments, the apparatus 100 may comprise footholds 120, wherein the footholds 120 may be configured to support feet from the user 50. Again with reference to FIGS. 2 and 3, exemplary footholds are shown in use by the user 50. The footholds 120 may be substantially proximate to the user support 110 and may be suitably coupled to one or a combination of the user support 110, the enclosure 150, and/or actuation mechanisms, such as the motor 160, the cable system 140, and the like. As shown by FIGS. 2 and 3, the footholds 120 may be adjustable to accommodate various positions of the user 50 during use of the apparatus 100, as well as to accommodate the various sizes of various users. The footholds 120 may comprise not only elements to hold the user's feet, but may also comprise members that couple the footholds 120 to other above disclosed elements to assist in supporting any one or combination of the user's ankles, calves, thighs, etc. In accordance with an exemplary embodiment, the footholds 120 may be variably positioned, for example the apparatus 100 may comprise upper footholds, such as footholds 120, but the apparatus 100 may also comprise lower footholds, such as footholds 222 and representatively shown in use by the user 50 in FIGS. 10D and 10G.

Figure 4:
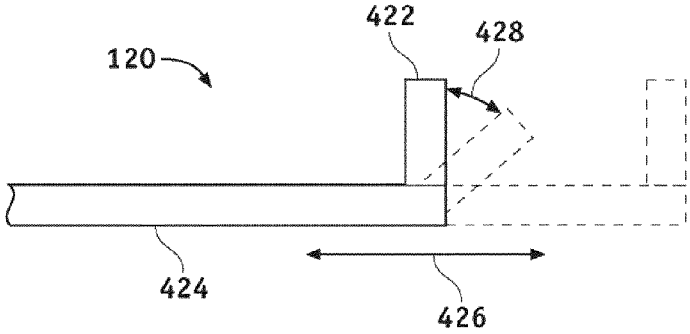
FIG. 4 representatively illustrates a schematic side view of an exemplary foothold, in accordance with the present invention.

With reference to FIG. 4, a side view of an exemplary foothold 120 is shown. The foothold 120 may comprise a footplate 422, which may be suitably coupled to a foothold member 424. As shown in FIG. 4, the foothold 120 may be adjustable. For example, the foothold member 424 may adjust in a telescopic or any other extending/retracting manner, as shown by direction arrow 426, to accommodate the preferences of the user 50. Moreover, the footplate 422 may be adjustable in a pivot wise manner, as shown by the direction arrow 428, to also accommodate the preferences of a user 50. In some embodiments the foothold plate 422 and/or the foothold member 424 may lock in position by clips, pins, hooks, snaps, and the like to secure their respective positions. In other embodiments, though, the foothold plate 422 and/or the foothold member 424 may be free to move during use of the apparatus 100 by the user 50. While the foothold 120 may be used to support the feet of the user 50, the foothold 120 may also fully and/or partially support the legs of the user 50.

Figure 5:
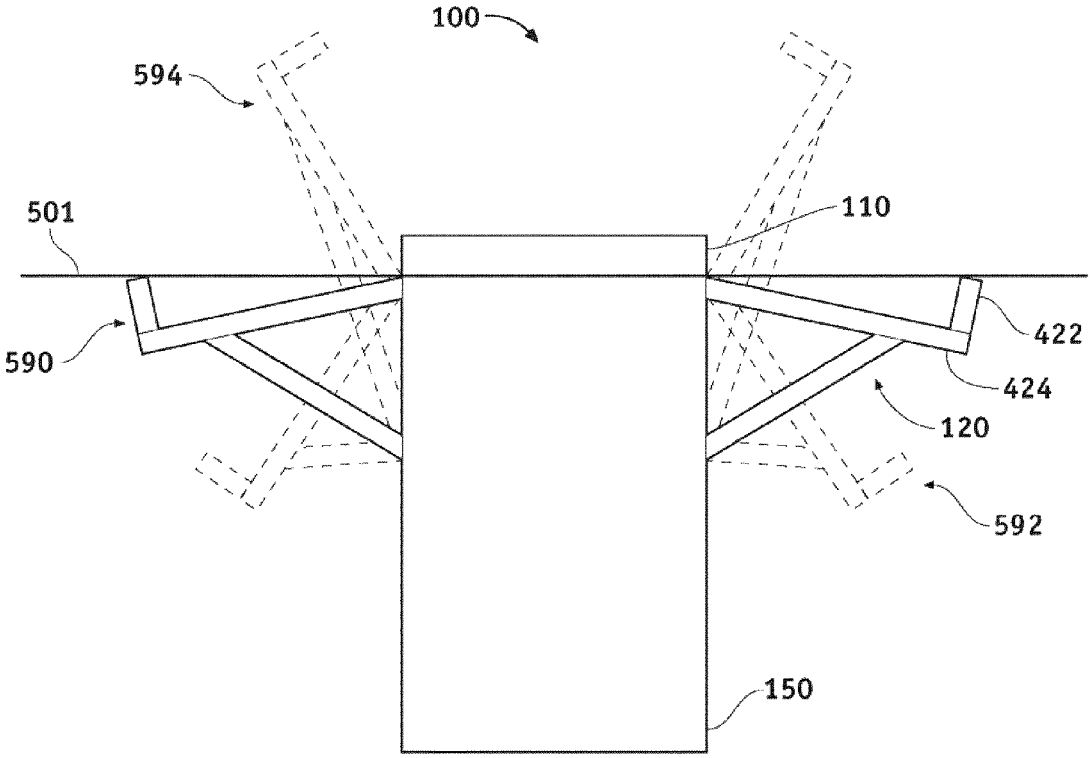
FIG. 5 representatively illustrates a schematic front view of an exemplary embodiment of the present invention showing various foothold positions.

With reference to FIGS. 2 and 3, the footholds 120 may be configured to facilitate supporting the legs and/or feet of the user 50 such that when the user 50 is seated upon the user support 110 the user 50 may comprise a seated straddled position. To facilitate this position, the footholds 120 may be configured to be substantially coplanar with the user support 110. In other embodiments, however, the footholds 120 may be alternately positioned such that feet and/or legs of the user 50 may be positioned above and/or below the plane of the user support 110. For example, with reference to FIG. 5, a front view of the apparatus 100 shows the footholds 120 in a standard substantially coplanar position 590 with the user support 110, for example plane 501. FIG. 5 also shows the footholds 120 in alternate positions, position 592 and 594, wherein either one or both of the footholds 120 may be positioned below the plane 501 of the user support 110, position 592, and/or above the plane 501 of the user support 110, position 594.

Figure 6:
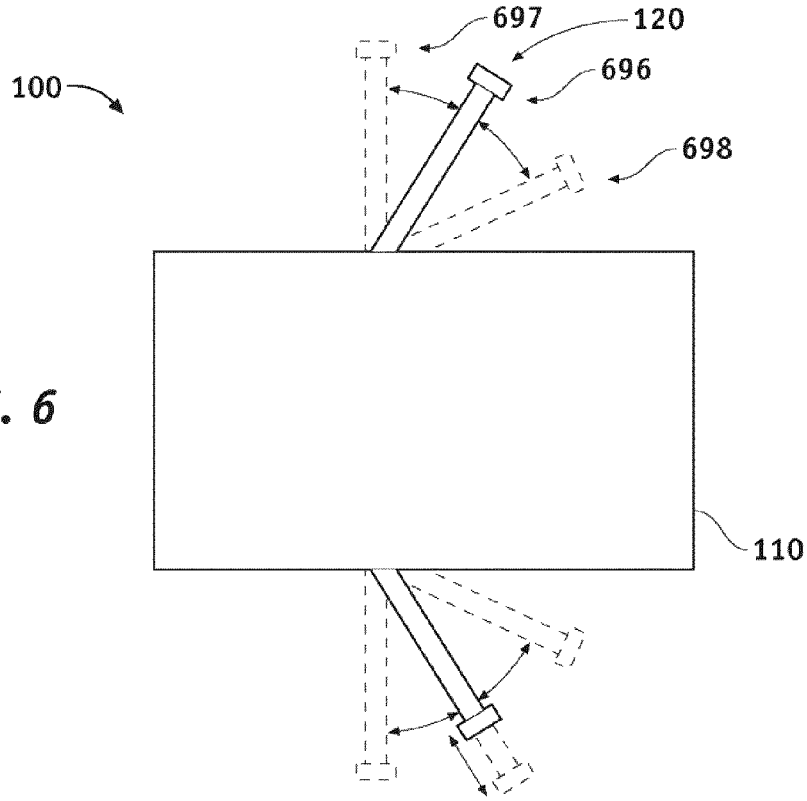
FIG. 6 representatively illustrates a schematic top down view of an exemplary embodiment of the present invention showing various alternative foothold positions.

With reference to FIGS. 2, 3, and 6, still other positions of the footholds 120 may be incorporated by the user 50 as they use the apparatus 100. These figures illustrate the various lateral positions the footholds 120 may be positioned at during use. For example, FIG. 2 shows the user 50 in a substantially straddled position, position 280, wherein the users legs are spread wide apart, thereby fostering a first type of muscle stretching when using the apparatus 100. FIG. 3, shows the user in an alternate position, position 385, wherein the user's legs are positioned substantially closer together, thereby fostering a second type of muscle stretching.

In an exemplary embodiment and with reference to FIG. 6, a top down view of the footholds 120 of the apparatus 100 are shown among a range of various lateral positions. For example, FIG. 6 shows the footholds 120 in a first position, position 696, but either one or both of the footholds 120 may be positioned in other manners, such as a wider position, as shown by position 697, and/or a narrower position, as shown by position 698, as well as any other position in between, farther apart, or closer together.

It should be noted that during use of the apparatus 100 by the user 50, the various positions of the footholds 120 may be set and secured in a desired position prior to use, but in some embodiments, the footholds 120 may comprise actuation mechanisms such that the positions of the footholds 120 may change during use.

It should further be noted that the various positions and/or configurations of the footholds 120 described above may also apply to the lower footholds 222. Moreover, any of the user 50 positions described herein, may further apply to the various exemplary user positions shown in FIGS. 10A-10J, but the present invention is not limited in this regard.

In accordance with an exemplary embodiment of the present invention, the apparatus 100 may comprise control handle 130. Control handle 130 may be used to further facilitate increasing the flexibility and/or stretching the muscles of the user 50. In an embodiment, the control handle 130 may be coupled to a cable of the cable system 140, wherein the cable system acutates to retract and/or feed the cable, thereby increasing and/or releasing the tension on the cable. In this manner, the increasing tension facilitates pulling the user 50 holding the control handle 130, and when the user 50 is positioned as shown and described above, such increasing tension facilitates the muscle stretching, thus increasing the flexibility of the user 50. The decreasing tension allows the user 50 to return to their starting position.

For example, with reference to FIG. 2 the user 50 is shown in a substantially starting position, sitting upright with the cable extended. FIG. 3 shows the user 50 in a substantially final position, sitting bent over with the cable retracted. As can be seen from these figures, repeated motions between the starting position and final position can effectively stretch the muscles of the user 50, thus increasing flexibility.

Figure 7:
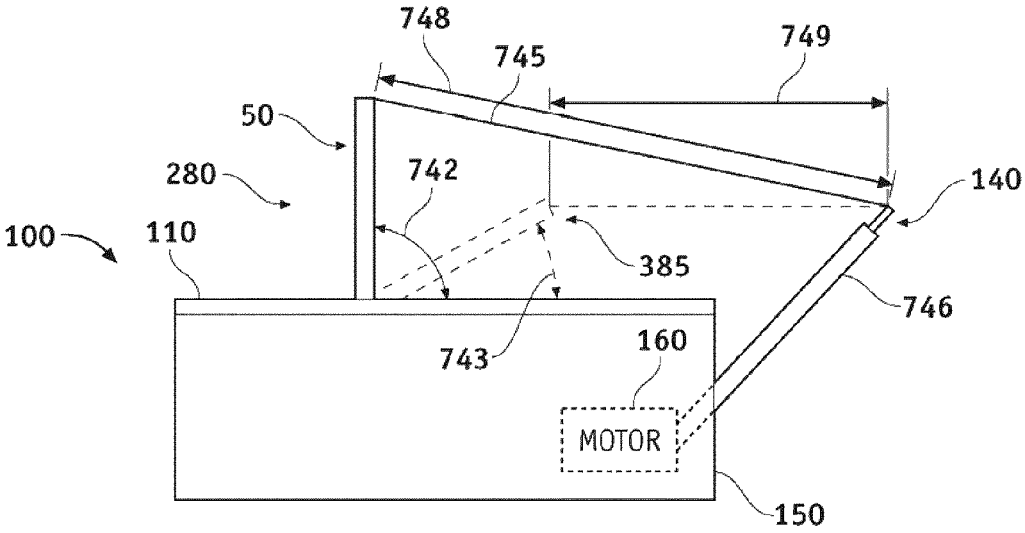
FIG. 7 representatively illustrates a schematic side view of an exemplary embodiment of the present invention showing various user positions when a cable of a cable system is retracted and extended.

As a further example and with reference to FIG. 7, a schematic of the movement between the starting and final position is shown. The user 50 set upon the user support 110 may comprise the initial upright position 280. In this position the cable 745 of the cable system 140 may comprise a beginning extended length 748. In the final position, position 385, the user 50 may comprise a final bent over position 385. In this position the cable 745, may comprise a final retracted length 749. By holding onto the control handle 130, the user is pulled from position 280 to position 385, thereby decreasing the angle between the user, i.e. the user's torso, and the user support 110; shown by angle arrows 742 and 743. It should be noted that among some embodiments and to prevent injury to the user 50, the cable system 140 may release the tension on the cable 745 if and/or when the cable tension achieves a predetermined value. In this manner, the user 50 is safe from hyper extending themselves, thereby preventing injury, such as pulling and/or tearing their muscles.

Figure 8:
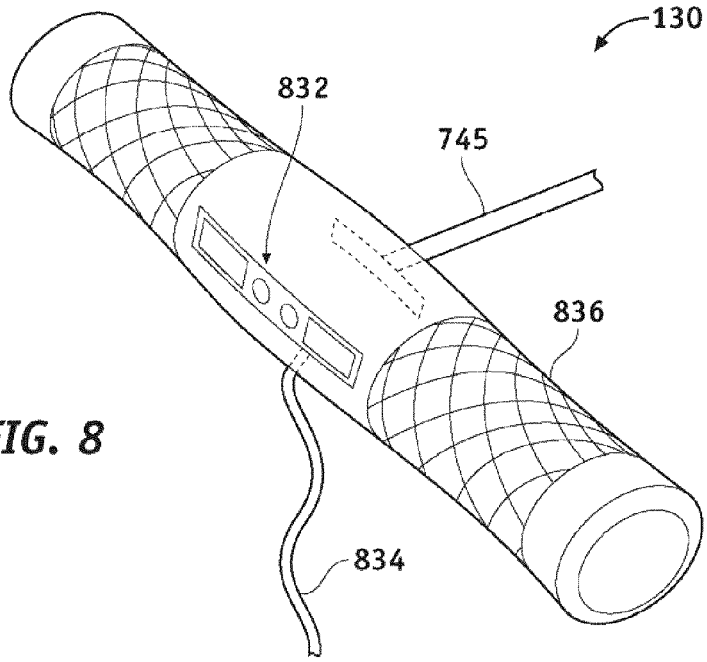
FIG. 8 representatively illustrates a close up view of an exemplary control handle.

With reference to FIG. 8, a close up of control handle 130 is shown. In an exemplary embodiment control handle 130 may comprise controls 832, cable 745, control communication cable 834, and/or hand grips 836. Controls 832 may comprise various electronic switches, controls, settings, and the like to facilitate operation of the apparatus 100. The controls may comprise simple on/off switches or may comprise variable resistance type switches to control, for example, variable value levels. For example, the controls 832 may actuate the extension and/or retraction of the cable 745. The controls may operate the cable system 140 as well as any foothold 120 movements and/or settings. The controls 832 may also control power, speed, timing, cable 745 tension levels, and the like. In some embodiments, the controls 832 may further comprise visual displays and/or other outputs, such as audio and touch sensory feedback mechanisms. Among the various embodiments, the controls 832 may communicate with other apparatus 100 components via the control communication cable 834, but in some embodiments, the communication may be conducted wirelessly using infrared and/or radio receiving/transmission elements. In still other embodiments the control communication cable 834 and/or any wireless embodiments may communicate with not only other components of the apparatus 100, but may also be configured to communicate with other devices, such as a PC, a cell phone, a PDA, and the like so as to convey usage information. Such usage information may be useful to track a user's progress, to monitor maintenance schedules, and the like. In still yet other embodiments, in addition to control communication cable 834 and/or any other wireless embodiments, the control handle 130 may comprise internal memory capabilities, removable memory capabilities, and the like to further store and/or provide information.

In accordance with exemplary embodiments, the control handle 130 may comprise grips 836 for the user 50 to hold during use of the apparatus 100. In the example shown in FIG. 8, the control handle comprises a straight bar comprising textured areas 836 to facilitate a secure grip by the user 50. It should be understood, however, that any type of control handle configuration may be used without departing from the scope of the present invention. For example, the control handle 130 may comprise contoured portions to conform more readily to the user's grasp, or the control handle 130 may comprise other shape configurations, such as a T-bar, an H-bar, and the like.

In accordance with an exemplary embodiment of the present invention, the apparatus 100 may comprise cable system 140. The cable system 140 may suitably couple the control handle 130 to a drive mechanism, such as the motor 160, which may operate to feed and/or retract the cable 745 thereby respectively increasing and/or releasing tension in the cable 745, and thus facilitating the use of the apparatus 100 to increase flexibility and/or stretch the muscles of the user 50. With return reference to FIG. 7, the cable system 140 may comprise the cable 745 that may be suitably coupled, via extension arm 746, to an internal drive motor 160. As briefly described above, when the user 50 is in the beginning upright position 280, the cable system comprising the cable 745 may comprise a beginning extended length 748. In the final position, position 385, the user 50 may comprise a final bent over position 385 when the cable 745 comprises a final retracted length 749.

In accordance with an exemplary embodiment, using the controls 832 on the control handle 130, the user 50 may initiate the cable system 140. For example, the motor 160 may be actuated via the controls 832 to begin retracting the cable 745, thereby increasing the tension on the cable 745, and thus pulling the user 50. Once the user 50 reaches the final position 385, the motor 160 may reverse direction to feed cable 745, thereby decreasing the tension on the cable 745, thus allowing the user 50 to return to the starting position 280.

Figure 9:
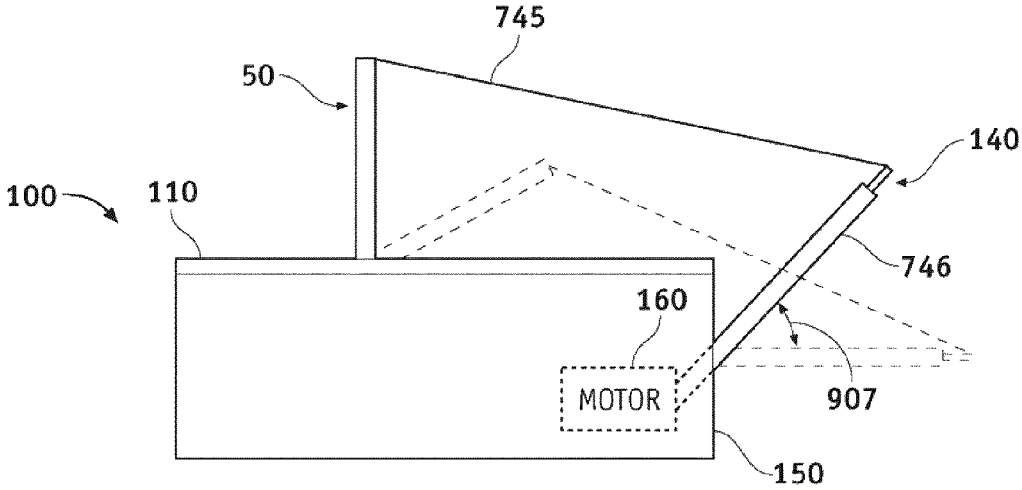
FIG. 9 representatively illustrates a schematic side view of an exemplary embodiment of the present invention showing an alternative cable system.

In accordance with an alternate embodiment, the cable system 140 may not operate to feed or retract the cable 745, but rather, as shown in FIG. 9, the cable 745 may be fixed and the motor 160 may operate to raise and/or lower the extension arm 746 to facilitate moving the user from the starting position 280 to the final position 385, direction arrow 907. In still yet another embodiment, the cable system 140 may be configured to both feed and/or retract the cable 745 as well as raise and/or lower the extension arm 746. It should be noted that the retraction and feeding of the cable 745, and the raising and/or lowering of the extension arm 746 are merely two examples of components that facilitate any "pulling" and/or "releasing" of the user 50 to effectuate increasing flexibility and/or stretching their muscles. It should be appreciated that any other like components that facilitate such movement of the user 50 are contemplated by this disclosure, for example, rods, pistons, pulleys, gears, fly wheels, levers, screws, etc.

Figure 10A:
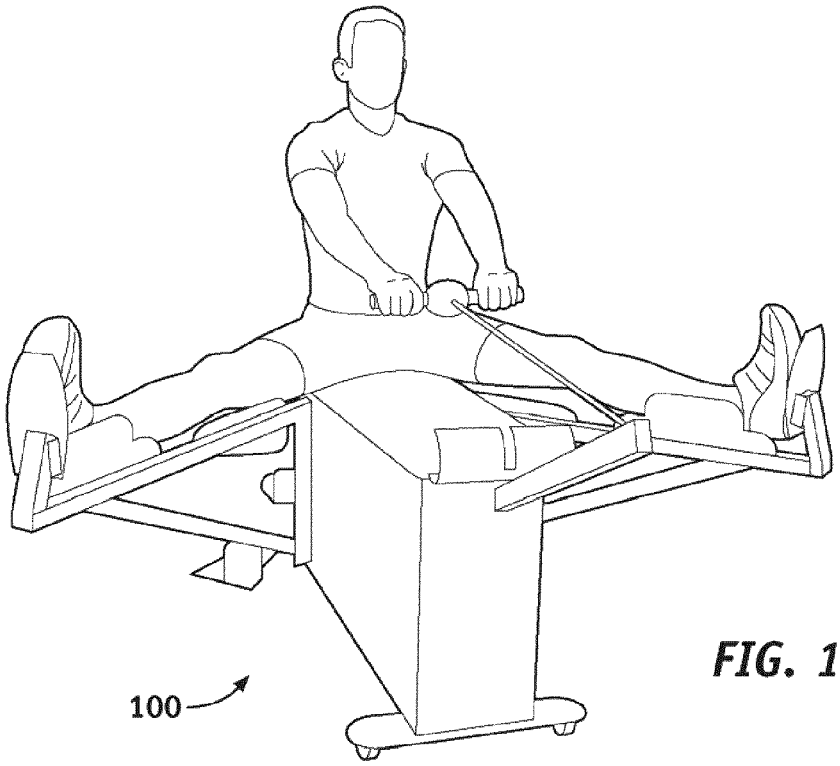
FIGS. 10A-10J representatively illustrate various operating positions a user may employ during use of the present invention.
Figure 10B:
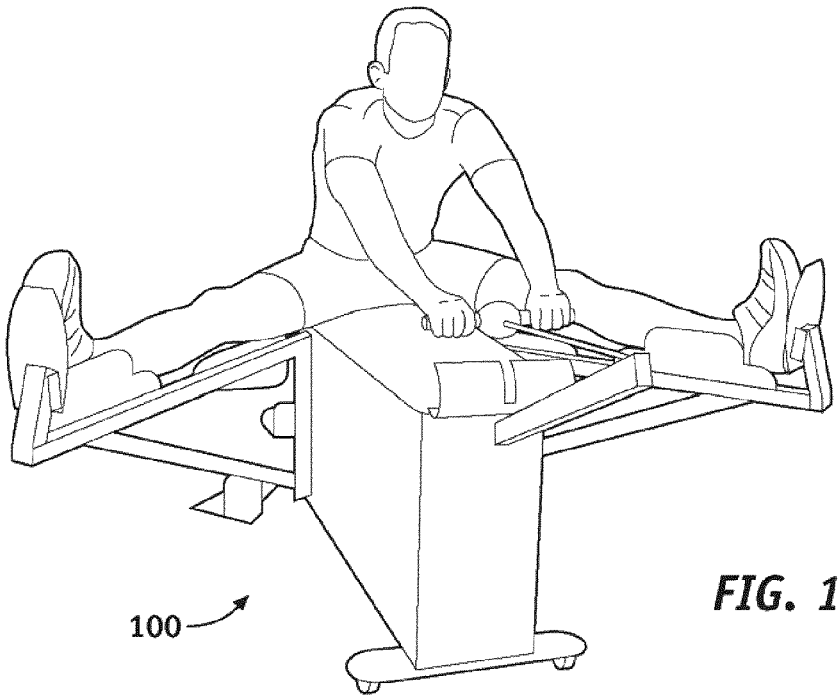
Figure 10C:
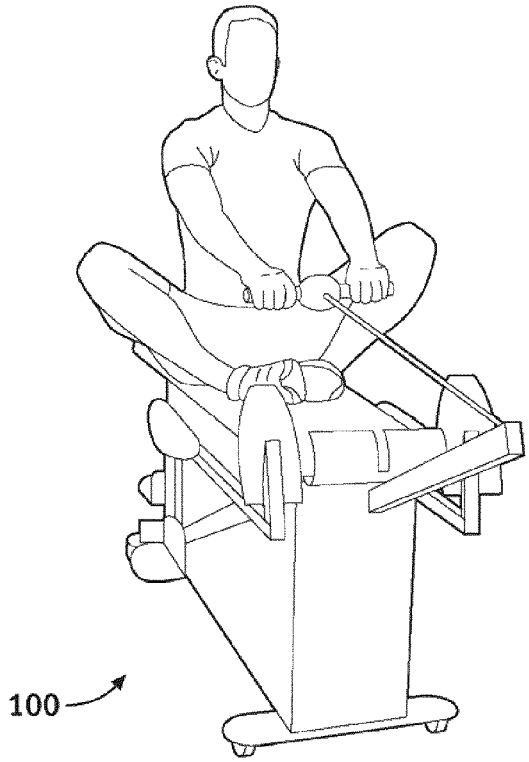
Figure 10D:
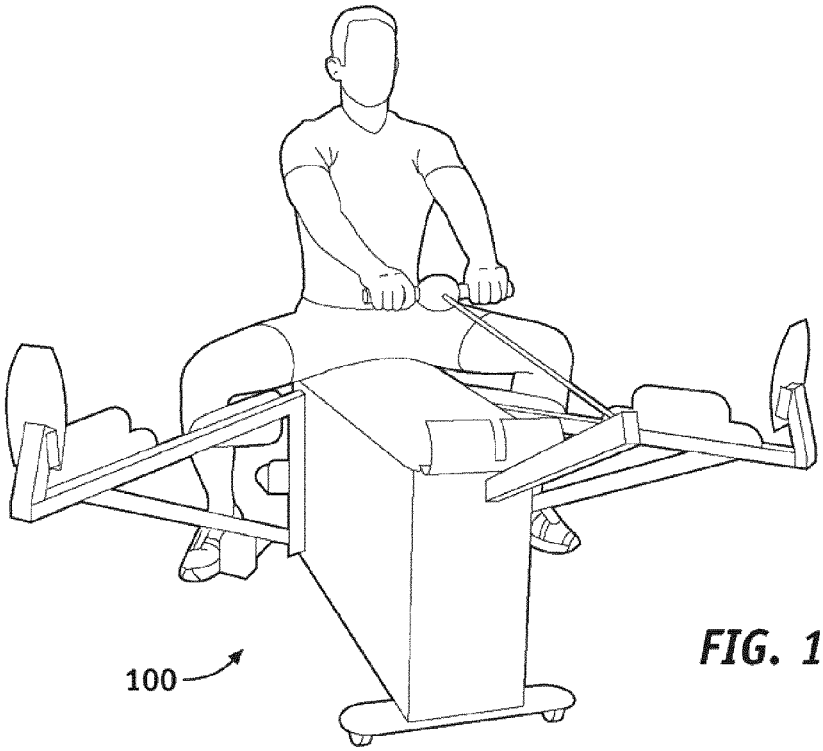
Figure 10E:
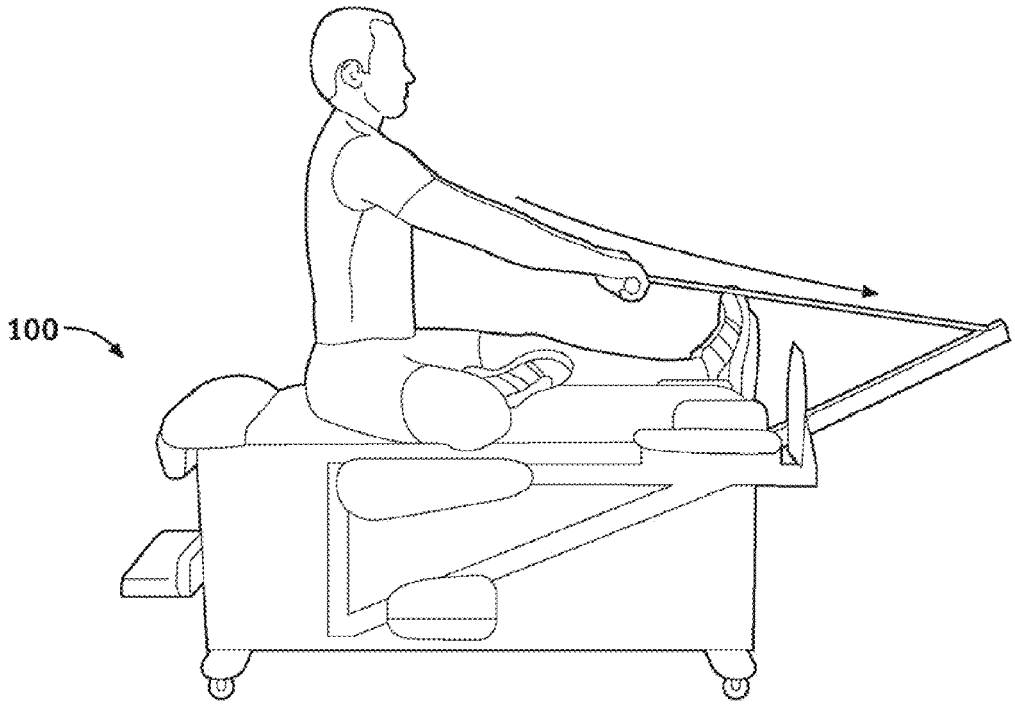
Figure 10F:
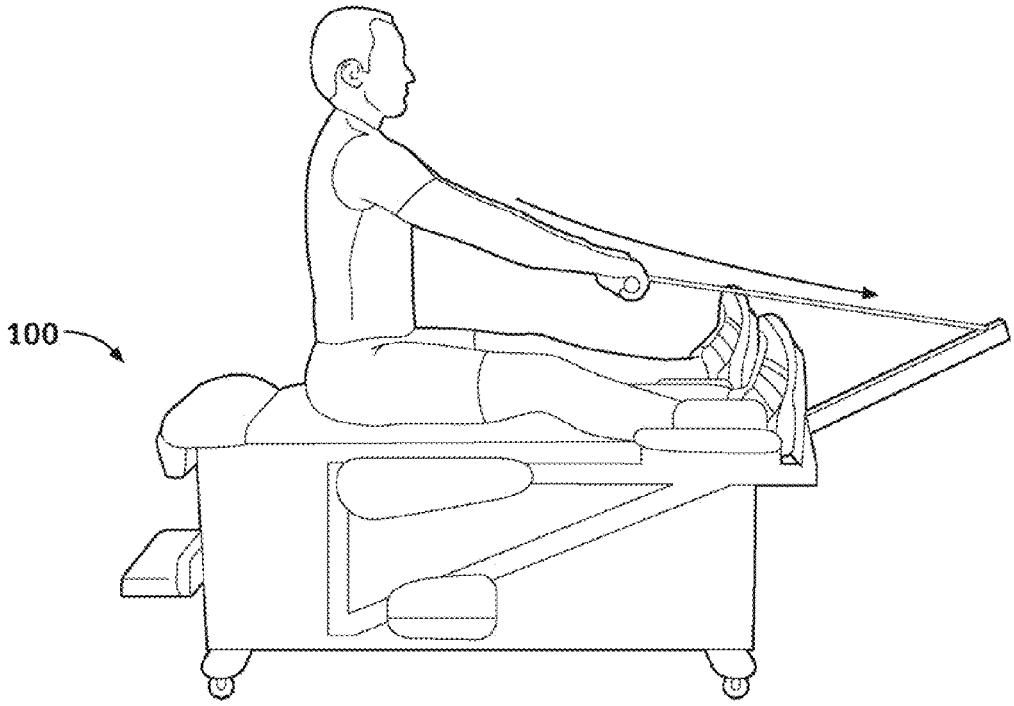
Figure 10G:
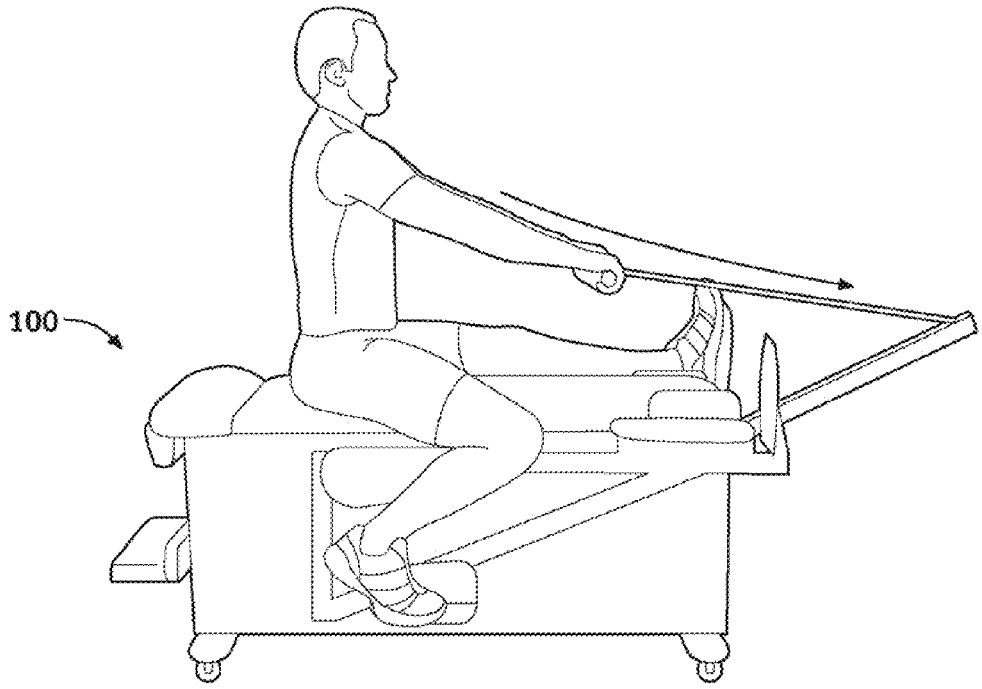
Figure 10H:
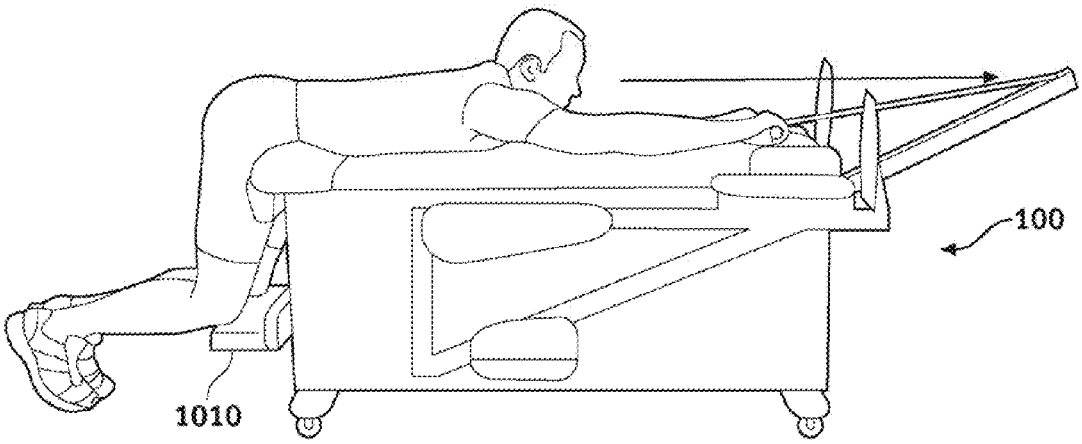
Figure 10I:
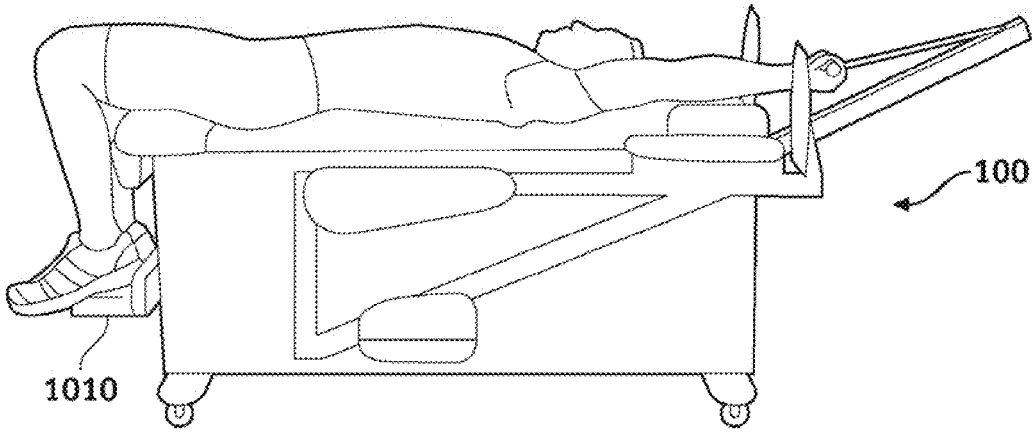
Figure 10J:
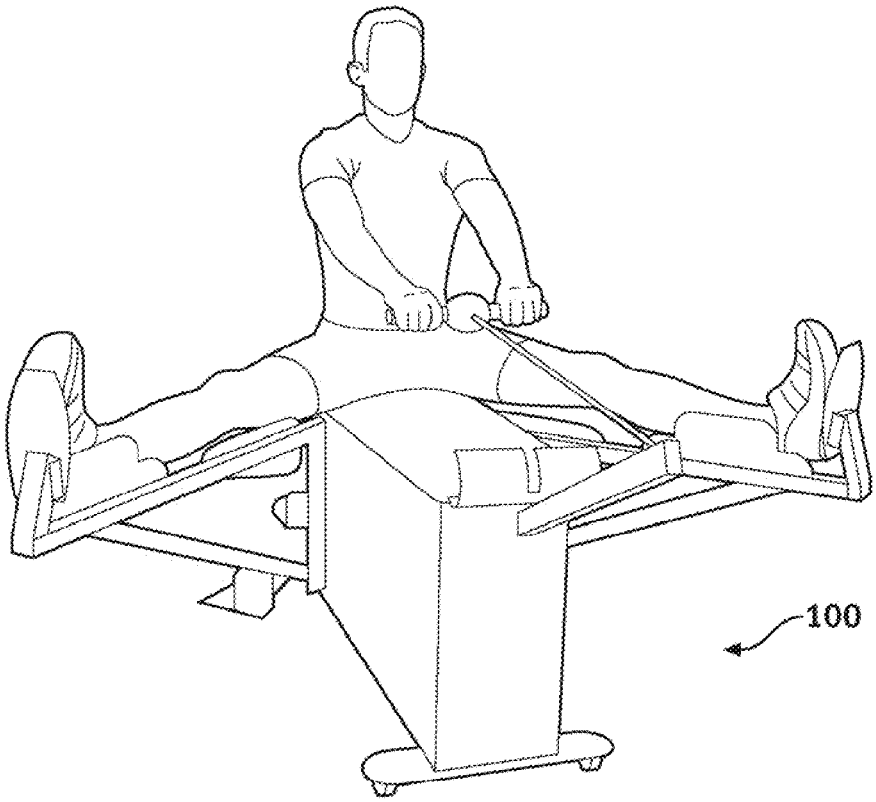

In accordance with an exemplary embodiment, and as mentioned briefly earlier, the user 50 may employ many variable positions to realize the benefits of the apparatus 100, and FIGS. 10A-10J representatively illustrate many, but certainly not all of the exemplary positions. For example, FIG. 10A shows a standard splits position, FIG. 10B shows a splits forward position, FIG. 10C shows a hip adductor stretch, FIG. 10D shows a hip joint stretch, and FIG. 10E shows a hip external rotator and extensor stretch. In other examples, FIG. 10F shows a seated knee flexor and hamstrings stretch, FIG. 10G shows a raised-leg knee flexor and hamstrings stretch, FIG. 10H shows a prone spine and shoulder stretch, and FIG. 10I shows a supine spine and shoulder stretch. FIG. 10J shows an exemplary splits stretch along with the various muscles that may be affected.

In accordance with the variable positions, the user 50 may operate the apparatus 100 comprising various reps, which may comprise various time intervals and/or in a graduated fashion (or other custom designed fashion) increase and/or decrease the tensions.

In accordance with an exemplary embodiment of the present invention, the apparatus 100 may comprise various internal operating components, such as the motor 160 to facilitate the use of the apparatus 100. For example, the motor 160 may be suitably coupled to the cable 745 to retract and/or feed the cable 745. In another embodiment, the motor 160 may be suitably coupled to the extension arm 746, and in still yet another embodiment the motor 160 may be suitably coupled to the footholds 120, or perhaps suitably coupled to the user support 110, such as a movable seat. The motor 160 may be suitably coupled to any one or any combination of these components as well as others now known or developed in the future.

It should further be noted that the motor 160 is merely one internal element configured to facilitate actuating the various components of the apparatus 100, and other internal elements are contemplated by this disclosure. For example, other internal components may comprise various combinations of drives, pulleys, gears, pistons, rods, shocks, sprockets, chains, belts, and the like, to facilitate operation of the apparatus 100.

In accordance with an exemplary embodiment of the present invention, the apparatus 100 may comprise various electronics 170 to further facilitate use of the apparatus 100. As briefly described throughout, the electronics 170 may be suitably coupled to various components to receive input, such as power from a power cord, communication from the control communication cable 834, drive and/or operating information from the motor 160, the cable 745, the extension arm 746, the footholds 120, and the like. The electronics 170 may also be suitably coupled to various components to provide output, such as communication to the control communication cable 834, drive and/or operating information to the motor 160, the cable 745, the extension arm 746, the footholds 120, and the like. Among the various exemplary embodiments, the electronics 170 may also comprise various memory components, processors, drives, and the like.

In accordance with an exemplary embodiment of the present invention, the apparatus 100 may comprise the enclosure 150. The enclosure 150 may house various operating components of the apparatus 100, such as the motor 160, electronics 170, as well all or a portion of the cable system 140. The enclosure 150 may also provide a top surface to secure the user support 110, such as a bench. The enclosure 150 may also comprise a structure to provide couplings for the footholds 120, the extension arm 746, etc. It should be noted that among the various exemplary embodiments, the enclosure 150 may be configured to house certain components, but other embodiments may comprise such components to be positioned outside of the enclosure 150 or completely apart from the enclosure 150. For example, components such as the motor 160, the electronics 170, portions of the cable system 140, etc., may be positioned outside or completely apart from the enclosure 150.

Figure 11:
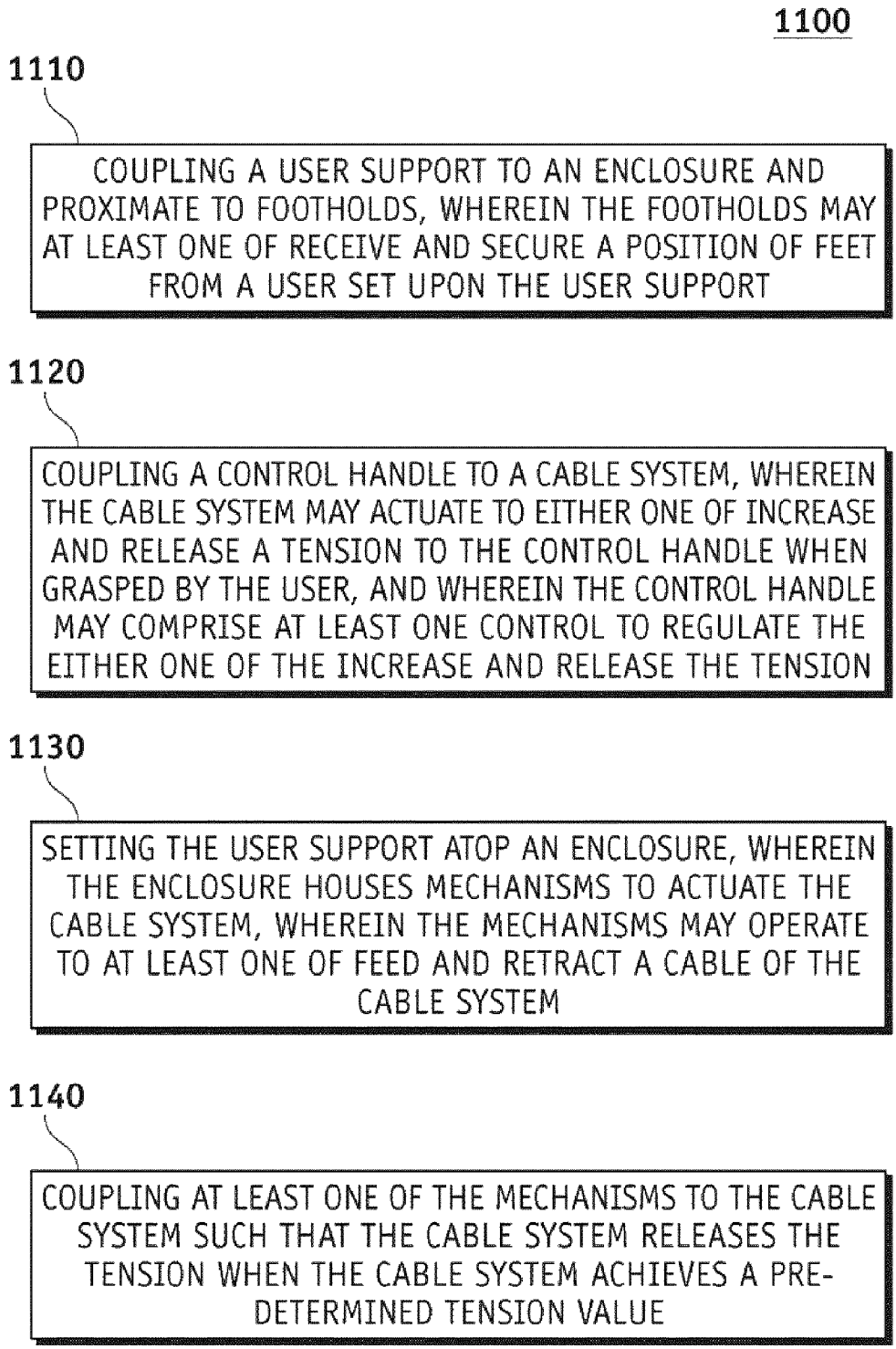
FIG. 11, in accordance with an exemplary embodiment of the present invention, illustrates a flow chart for manufacturing an exemplary apparatus.

In accordance with an exemplary embodiment of the present invention, and with reference to the flow chart shown by FIG. 11, a method 1100 for manufacturing an apparatus, such as apparatus 100, may comprise coupling a user support to an enclosure and proximate to footholds, wherein the footholds may at least one of receive and secure a position of feet from a user set upon the user support (1110). The method 1100 may further comprise coupling a control handle to a cable system, wherein the cable system may actuate to either one of increase and release a tension to the control handle when grasped by the user, and wherein the control handle may comprise at least one control to regulate the either one of increase and release the tension (1120). In accordance with an exemplary embodiment, the method 1100 may further comprise setting the user support atop an enclosure, wherein the enclosure houses mechanisms to actuate the cable system, and wherein the mechanisms may operate to at least one of feed and retract a cable of the cable system (1130). The method 1100 may further comprise coupling at least one of the mechanisms to the cable system such that the cable system releases the tension when the cable system achieves a predetermined tension value (1140).

In accordance with exemplary embodiments of the present invention, various methods may also comprise packaging the apparatus and/of system, marketing the apparatus and/or system, drafting instructions to use and/or assemble the apparatus and/or system, and the like. Among the various methods, the user support may be similar to user support 110 and/or 1010; the footholds may be similar to footholds 120 and/or 222, the control handle may be similar to control handle 130, the cable system may be similar to cable system 140, the cable may be similar to cable 745, the mechanisms may be similar to the motor 160 and/or the electronics 170, and the enclosure may be similar to the enclosure 150.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus or system claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, system, composition or apparatus that comprises a list of elements does not include only those elements recited, but may also include other elements not expressly listed or inherent to such process, method, article, system, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An apparatus for increasing the flexibility of a user's muscles comprising;

a user support;

a control handle coupled to a cable system, wherein the cable system actuates to either one of increase and release a tension to the control handle, and wherein the control handle comprises at least one control to regulate the either one of increase and release the tension;

a motor coupled to the cable system and coupled to the control handle, the motor configured to at least one of feed and retract a cable of the cable system;

an enclosure wherein the user support is coupled to a top surface of the enclosure and the motor is fastened to an interior portion of the enclosure: and an extension connected to the enclosure and interfaced to the cable system between the control handle and the motor.

2. The exorcise apparatus according to claim 1, further comprising a pair of footholds pivotally mounted to opposite sides or the enclosure and in communication with the motor and the control handle.

3. The exercise apparatus according, to claim 1, an electronic interface configured to provide communication with the motor and to provide control of the motor by at least one controller located in the control handle.

4. The exercise apparatus according to claim 3, further comprising a memory in communication with the electronic interlace and configured to at least one of store an exercise routine and provide movements of the exercise routine to the apparatus.

* * * * *

UNITED STATES PATENT AND TRADEMARK OFFICE

CERTIFICATE OF CORRECTION

PATENT NO. : 7,981,015 B2
APPLICATION NO. : 12/488903
DATED : July 19, 2011
INVENTOR(S) : Michael Reed It is certified that error appears in the above-identified patent and that said Letters Patent is hereby corrected as shown below:

In column 10, claim 2, line 7, please delete "exorcise" and insert --exercise--

Signed and Sealed this
Thirtieth Day of August, 2011

David J. Kappos

David J. Kappos
*Director of the United States Patent and Trademark Office*